US006125771A

United States Patent [19]

Platt et al.

[11] Patent Number: 6,125,771

[45] Date of Patent: Oct. 3, 2000

[54] CONFORMALLY FOLDING TABLE

[75] Inventors: Steven H. Platt, Emeryville, Calif.; Robert W. Platt, Seattle, Wash.

[73] Assignee: David L. Garrison PS, Seattle, Wash.

[21] Appl. No.: 09/229,978

[22] Filed: Jan. 13, 1999

Related U.S. Application Data

[60] Provisional application No. 60/071,444, Jan. 14, 1998.

[51] Int. Cl.[7] ..... A47B 3/00

[52] U.S. Cl. ..... 108/115; 108/152; 108/67

[58] Field of Search ..... 108/115, 42, 38, 108/67, 152

[56] References Cited

U.S. PATENT DOCUMENTS

| | | | |
|---|---|---|---|
| Re. 23,996 | 5/1955 | Sieminski | 108/48 |
| 3,079,875 | 3/1963 | Hasler | 108/38 |
| 3,736,884 | 6/1973 | Kohner | 108/48 |
| 4,026,219 | 5/1977 | Shupe et al. | 108/67 X |
| 4,782,764 | 11/1988 | Robinson . | |
| 4,889,057 | 12/1989 | Chartrand | 108/38 X |
| 4,958,577 | 9/1990 | Demaio et al. | 108/67 X |
| 5,197,381 | 3/1993 | Mells | 108/48 X |
| 5,203,266 | 4/1993 | Stevens . | |
| 5,363,941 | 11/1994 | Richard | 108/152 X |
| 5,411,192 | 5/1995 | Xiao | 108/48 X |
| 5,421,272 | 6/1995 | Wilmore . | |
| 5,425,315 | 6/1995 | Huggins . | |
| 5,445,085 | 8/1995 | Westerburgen . | |
| 5,460,104 | 10/1995 | Young, Sr. . | |
| 5,469,794 | 11/1995 | Laderoute et al. . | |
| 5,501,157 | 3/1996 | Westerburgen . | |
| 5,513,574 | 5/1996 | Collins . | |
| 5,540,158 | 7/1996 | Ford . | |
| 5,577,818 | 11/1996 | Sayre . | |
| 5,622,119 | 4/1997 | Hsieh . | |
| 5,884,566 | 3/1999 | Chen | 108/67 |
| 5,890,437 | 4/1999 | Hill | 108/51.11 X |

*Primary Examiner*—Jose V. Chen
*Attorney, Agent, or Firm*—David L. Garrison; Garrison & Associates PS

[57] ABSTRACT

A conformally folding table comprises a surface assembly and a support member adapted to pivotally attach the surface assembly to a structure such as a post or mast. The surface assembly comprises a plurality of surface members and is adapted, upon being pivoted into a stowed position, to fold or "wrap," by means of relative rotations between adjacent surface members, around the structure and into close conformance with it, so as to allow storage of the table in a minimum of space. When the table is to be used, the table is pivoted away from the structure into a deployed position and the surface members are unfolded or "unwrapped" to form a flat table surface. Preferred embodiments of the table also comprise one or more legs for stability and a lateral support member to help support the surface members in forming a flat table surface.

11 Claims, 7 Drawing Sheets

CONFORMALLY FOLDING TABLE

This application claims the benefit of U.S. provisional patent application No. 60/071,444, entitled Conformally Folding Table and filed Jan. 14, 1998.

TECHNICAL FIELD

The invention relates to folding furniture, and more particularly to method and apparatus for tables adapted for conformal folding about structures.

BACKGROUND OF THE INVENTION

It is often necessary or desirable to use tables and other furniture in cramped or close spaces. For example, sailboats, yachts, recreational vehicles, campers, and like vehicles and structures often lack large spaces where bulky furniture such as tables might be kept. This is particularly so in the cabins of such structures, which typically constitute main living areas and in which it is often critical to maintain as much open or useable space as possible—although such cabins typically represent the largest spaces available, they are barely large enough to accommodate furniture items such as tables. The problem is particularly acute where it is necessary or desirable that tables or furniture be permanently or semi-permanently installed.

Folding tables and furniture have been seen as an answer to this problem. Many folding tables, chairs, etc., are known. In the case of sailboats, for example, a well-known solution has been to provide tables capable of folding down the middle, as shown in FIG. 1. Prior art table 10 of FIG. 1 comprises leaves 11, center panel 12, structural support assembly 13, and legs 14. Center panel 12 is rigidly and permanently attached to structure 20 by means of support assembly 13, while leaves 11 are attached to the center panel by hinges 15 and legs 14 are pivotally attached to the center section. When not in use, the table is "stowed", to the extent stowage is possible with such arrangements, by rotating legs 14 about pivots 16 so that they are more or less aligned beneath center section 12 and letting leaves 11 drop to the vertical by hinges 15. Center section 12 being monolithic and rigid, the greater portion of the bulk of the table is left to occupy the cabin or other space in which the table is mounted, with both center section 12 and large leaves 11 blocking relatively large portions of what might otherwise be open passage or storage space, or space generally available for other uses. For use the table is erected by lifting leaves 11 roughly to the horizontal and rotating legs 14 so that their horizontal portions 17 support the leaves in an approximately horizontal position. It is characteristic of such tables, however, that support legs 14 never quite succeed in bringing or holding leaves 14 horizontal; there is invariably some downward slope to the leaves which results in at least inconvenience to the user, and sometimes in the practical unusability of the table. For example, the placement of vessels containing fluids on non-level surfaces is at best problematical, particularly when the table is in motion, as for example when it is installed on a boat on the open water, pitching and rolling with the waves. It is also inevitable that the problem is exacerbated by the tendency of gravity and any loads induced by objects placed on the table to push the leaves of such tables down out of and away from the horizontal.

Another approach to the provision of permanently or semi-permanently mounted tables in limited spaces is shown in U.S. Pat. No. 5,460,104 to Young. The table disclosed in the Young patent comprises a dual-section hinged table top supported by a pair of highly curved legs. For stowage, a free end of the table is released to hang downwards and the pair of curved legs are slid through a pair of support slots into a position beneath a bench or other structure, so as to be more or less out of view and out of the way of activities carried out before the bench, etc. The table would appear to be both relatively clumsy and relatively difficult to use, however, and prone to various mechanical difficulties (as for example the jamming of the legs in their support slots) and to the same gravitational difficulty as the previously-described prior art table—namely, that the hinged portion of the table top will rarely achieve an entirely horizontal position, as both gravity and the loads induced by any objects placed on the tabletop will tend to deflect the tabletop downwards out of the vertical.

U.S. Pat. No. 5,513,574 to Collins discloses a relatively conventional wall-mounted table comprising a substantially monolithic, rigid tabletop. For storage the Collins table requires a free wall area at least as large as the largest tabletop section, thus occupying wall space which might, particularly in space-limited vehicle applications such as boats, be well put to other use.

Largely the same difficulties, for applications in which limited space is available, arise in the use of the tables disclosed in U.S. Pat. No. 5,540,158 to Ford and U.S. Pat. No. 5,421,272 to Wilmore. Each of these references discloses a table comprising relatively large, rigid table top sections which must be accommodated in some fashion by the structure in which it is stored. Moreover, the Wilmore table discloses no means for securing the table inside a vehicle—which can, in the case of such tables, be a crucial requirement, as for example (as noted above) where the table is to be used in a moving vehicle such as a floating boat.

Yet another approach to the stowage of tables in limited spaces is disclosed in U.S. Pat. No. 5,425,315 to Huggins. Huggins discloses a foldable table comprised of a series of radially disposed leaf members pivotally mounted about a central column member and supported by folding brackets. As regards the type of applications contemplated herein, however, the table disclosed by Huggins is subject to the same difficulties with gravity and tabletop loads as the other tables discussed, and in addition, the mechanism of the Huggins table is relatively bulky, with brackets, beam support members, and radial leaves being folded into the same space, so that the table would appear to occupy more space than is strictly necessary when folded. Moreover, the leaf assembly of the table top appears to be less than ideally suited to providing a substantially flat table top surface, inasmuch as its multitudinous leaves could not reasonably be expected to align reliably on repeated openings and closings; and the mechanism itself would appear to be both complex and relatively difficult to operate, and expensive to build. Finally, the configuration disclosed carries with it inherent limitations as to the size of the table, and an inherent use limitation in that a column member is necessarily located in the center of the table. Thus even if the Huggins table were adapted for use in connection with a mast or other carry-through post or column, such as is likely to be encountered in a boat, the mast or post would invariably be immovably rooted in the center of the table, limiting the table's usefulness.

There has heretofore not been disclosed any table overcoming all of the aforementioned difficulties. There remains a need for a foldable table which is easy to operate, which incorporates a simple, uncomplicated inexpensive mechanism, which folds into a very small space, which does not require the presence of a post or column in the center of the table surface, which folds repeatedly and reliably to a substantially horizontal, planar configuration, and which may be economically produced, installed, and maintained.

DISCLOSURE OF THE INVENTION

Accordingly, it is an object of the invention to provide a table or other furniture item which is capable of being permanently or semi-permanently installed and used in a small space, and which is capable of folding easily into a minimal volume for stowage.

It is a further object of the invention to overcome each of the difficulties mentioned in connection with the prior art tables—that is, to provide a table which is among other things easy to operate, which incorporates a simple, uncomplicated, and inexpensive folding mechanism, which does not require the presence of a post or column in the center of the table surface, which folds repeatedly and reliably to a substantially horizontal, planar configuration, and which may be economically produced, maintained, and installed.

It is a further object of the invention to provide a strong, lightweight, durable, and reliable means for permanently or semi-permanently attaching the table of the invention to a structure, and in particular to attach the table pivotally to such structure, without incurring damage to the structure.

It is a further object of the invention to provide any or all of the above goals in a beautiful piece of parlor-grade furniture.

These and such other objects of the invention as will become evident from the disclosure below are met by the invention disclosed herein. The invention provides a table adapted for permanent or semi-permanent installation next to or in conjunction with a structure, including in particular such structures as columns, posts, or masts, and to fold conformally around such structures, occupying in stowage a minimum of space and freeing as much of the space in which the table is installed as possible, thus opening the space when the table is stowed to other uses, while providing when the table is opened or deployed a fully functional piece of elegant, high-quality furniture.

In basic form the table of the invention comprises a surface assembly and a support member adapted to pivotally attach the surface assembly to a structure such as a post or mast. The surface assembly comprises a plurality of surface members and is adapted, upon being pivoted into a stowed position, to fold or "wrap," by means of relative rotations between adjacent surface members, around the structure and into close conformance with it, so as to allow storage of the table in a minimum of space. To open the table for use, the surface assembly is pivoted away from the structure into a deployed position and the surface members are unfolded or "unwrapped" to form a flat table surface. Preferred embodiments of the table also comprise one or more legs for stability and a lateral support member to help support the surface members in forming a flat table surface.

A specific preferred embodiment of the invention comprises a surface assembly comprising at least three elongated surface members having sides, the surface members disposed in a series such that the sides of adjacent surface members are substantially juxtaposed, adjacent surface members being rotatably attached to each other by means of hinges such as pocket hinges; at least one stability member adapted to engage and provide support to the surface assembly when the table is in a deployed position; at least one lateral support member pivotally attached to one of the surface members and selectively engageable with a plurality of the remaining surface members, and adapted to support the surface members in a tabletop alignment; and a structural support member comprising a strap clamp adapted to pivotally attach the surface assembly to a mast or post; whereby the table may be pivoted into a stowed position relative to the structure and the surface assembly conformally folded about the structure; and the table may be pivoted into a deployed position and the surface assembly unfolded into a tabletop configuration. Optionally such embodiments further comprise a stowage restraint element adapted to support the table in the stowed position.

One aspect of the invention comprises a strap clamp which is particularly well suited to the permanent or semi-permanent attachment of the table of the invention to a structure or other carrier, without damage to the structure or carrier. A preferred embodiment of a clamp according to this aspect of the invention comprises a strap or band adapted to circumferentially engage a carrier. The strap comprises two ends and a retainer attached at or near the first end. The retainer is adapted to engage a bight or turn made in the strap between the first and second ends, and so to secure the strap. The clamp further comprises means for tightening the strap about the carrier and means for attachment of an object, as for example the table disclosed herein, to the strap, and thereby to the structure.

BEST MODE OF CARRYING OUT THE INVENTION

Figure 1:
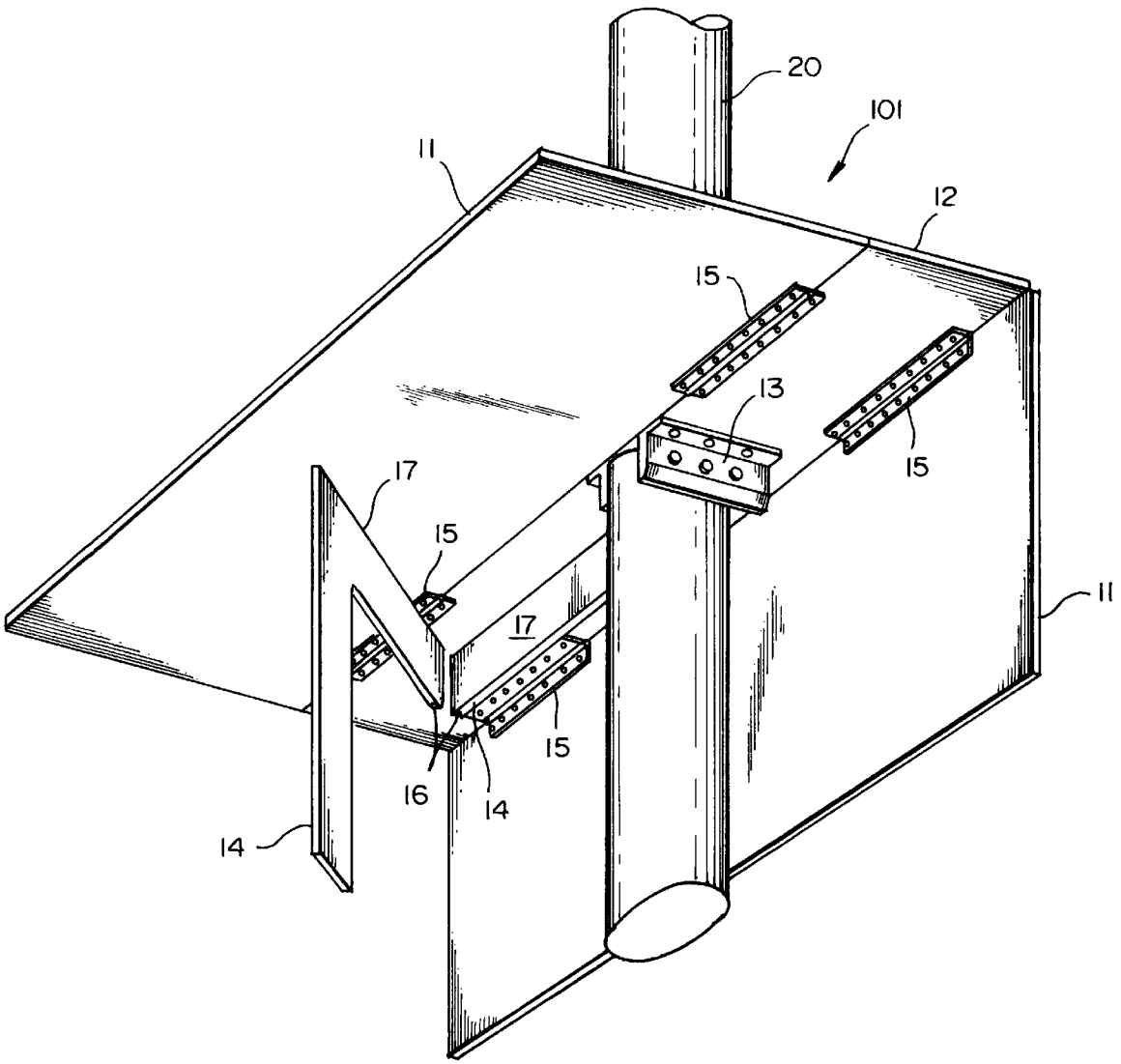
FIG. 1 PRIOR ART
FIG. 1 is a perspective view of a prior art folding table.

Turning now to the drawings, the invention will be described in a preferred embodiment by reference to the numerals of the drawing figures wherein like numbers indicate like parts.

Figure 2B:
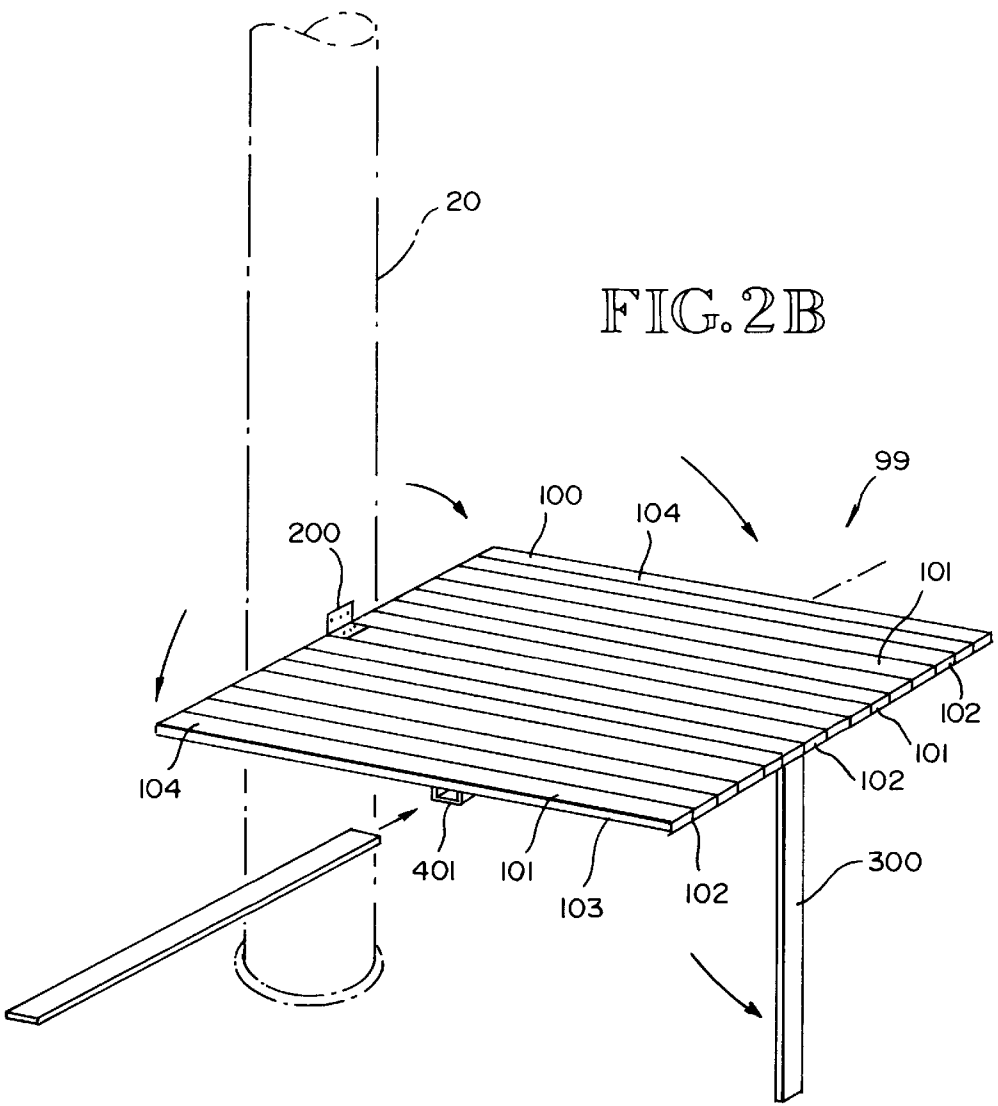
FIG. 2*b* is a perspective view of a deployed preferred embodiment of a conformally folding table according to the invention.
Figure 2A:
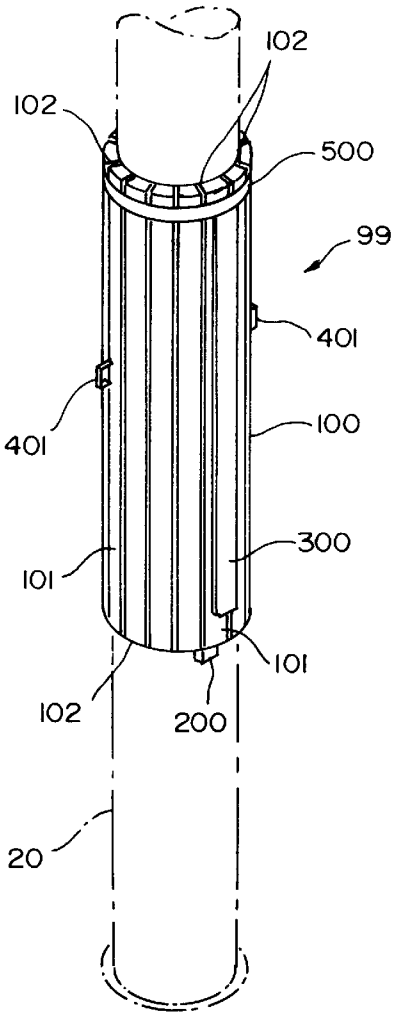
FIG. 2*a* is a perspective view of a preferred embodiment of a conformally folded table according to the invention.

FIG. 2*a* is a perspective view of a preferred embodiment of a stowed, conformally folded table according to the invention; FIG. 2*b* a perspective view of a deployed embodiment of the table. In general, table 99 comprises surface assembly 100, which comprises a plurality of surface members 101; structural support member 200; stability member 300; and lateral support member 400. In FIG. 2*a* table 99 has been pivoted upward about structural support member 200, which is attached to structure 20 (shown in broken line), into a stowed position against or adjacent to the structure. In this position stability member 300, which is rotatably attached to a central surface member of surface assembly 100, has been rotated down against the central surface member and the surface assembly has been conformally folded about the structure by rotations of the various surface elements 101 about rotational connectors 102—depicted in the Figure as "piano"-type hinges. The table is secured in the stowed position by optional stowage restraint element 500, which in this case is depicted as a strap encircling the table surface assembly and structure 20, conventionally connected by hook and loop fasteners or other appropriate means. Lateral support element 400, which is shown in these Figures as a separate part, is in the embodiment depicted separately stowed. In FIG. 2*b* the table has been pivoted about structural support member 200 into a deployed position in which surface members 101 of the surface assembly have been rotated or unfolded about their hinges into a flat or substantially planar, smooth tabletop configuration, with support member 300 rotated down into position to support the surface assembly by providing a structural load path between the surface assembly and the floor. With the surface assembly unfolded into a substantially planar configuration, optional lateral support member 400 may be put into place adjacent to a plurality of the surface members 101 to hold or support them in substantially planar alignment. In the embodiment shown this entails engaging the ends of lateral support element 400 in support brackets 401, one of which is located on either side of the surface assembly.

Figure 3:
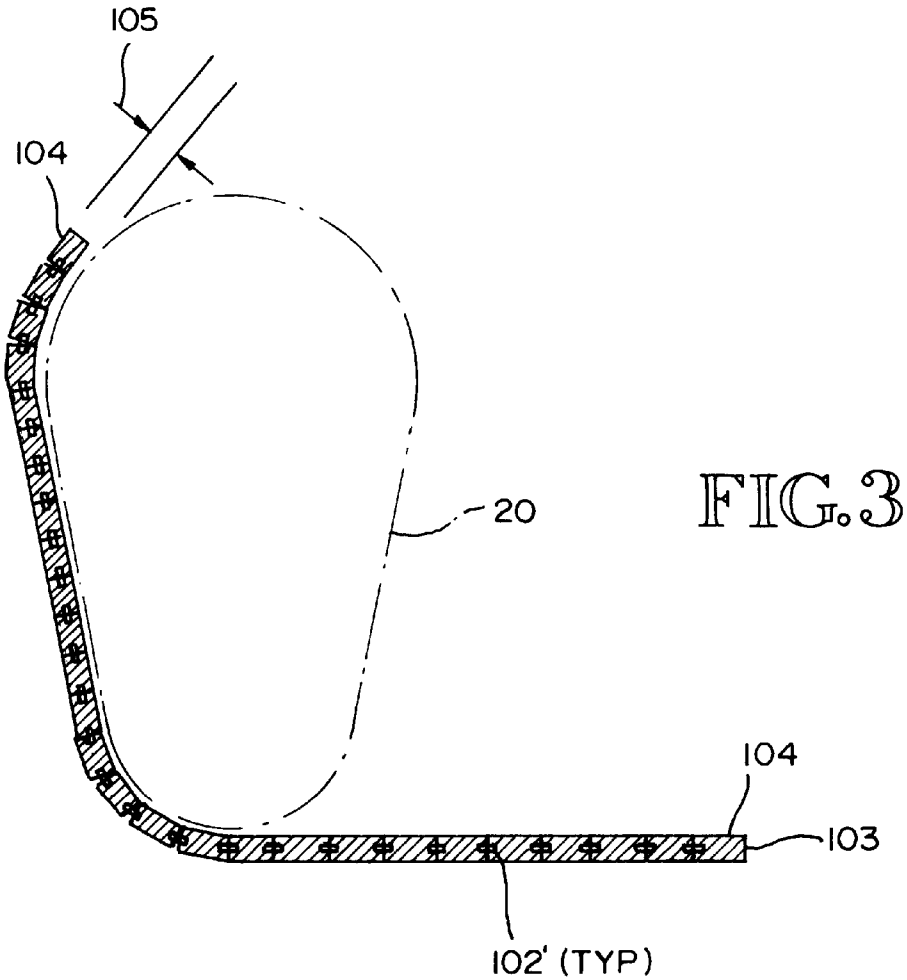
FIG. 3 is a cross-section of a preferred embodiment of a partially conformally folded surface assembly according to the invention.
Figures 4A, 4B:
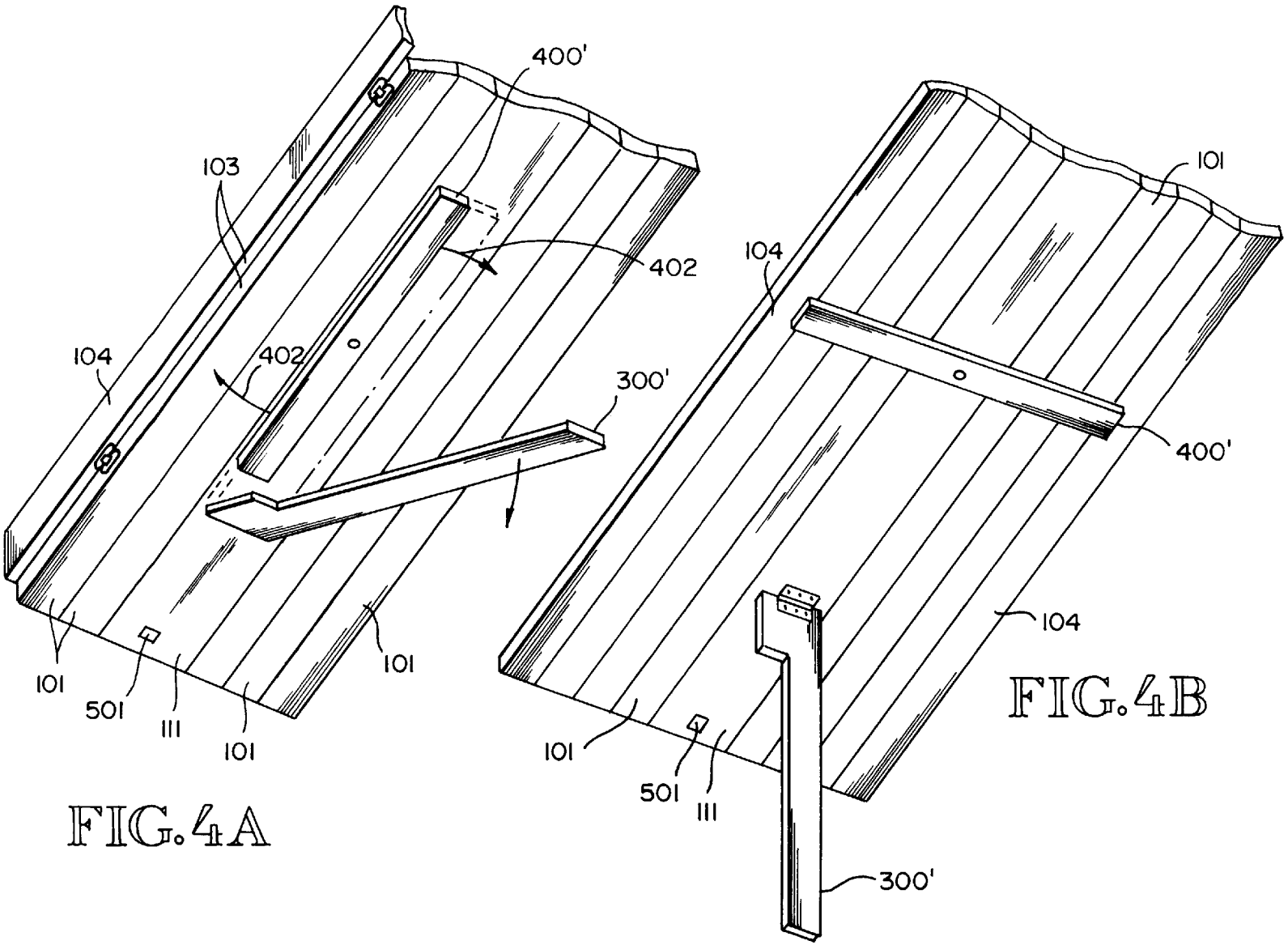
FIG. 4*a* is a partial perspective view of a partially deployed alternative preferred embodiment of a conformally folding table according to the invention.
FIG. 4*b* is partial perspective view of a deployed alternative preferred embodiment of a conformally folding table according to the invention.

In general the surface assembly of the invention comprises a plurality of surface members 101 having sides 103; typically at least three such surface members are present in a table assembly. The surface members are disposed or laid out side by side in a series, such that the sides of adjacent surface members are substantially juxtaposed or aligned, and adjacent surface members are rotatably attached to each other, as for example by means of hinges. In general adjacent pairs of surface members are independently articulated or rotatable, so that portions of the surface assembly may be rotated, or "folded", independently of other portions. This permits conformal folding of the table about structures of arbitrary cross section, as shown in FIG. 3. It also permits edge surface members 104 to be folded into an upright position, as shown in FIG. 4*a*, while other surface members are disposed in a flat tabletop configuration. Such a configuration is useful, for example, in keeping objects placed on the table from sliding off when the table is in motion, as where the table is installed on a boat on open water. In applications in which it is desired to keep edge surface members 104 in an upright position, any of a large variety of known mechanical means may be used to keep the edge members in place relative to the remainder of the surface assembly. In many embodiments the surface members take elongated form, as for example plastic or wooden 1"×2" or ½"×1" boards or planks. As will occur to those of ordinary skill in the art of furniture production, singular furniture beauty may be provided when the surface members are comprised of appropriately finished woods such as teak or maple.

To say that the surface assembly folds conformally around a structure is to say that the table folds or "wraps" relatively closely around the proximity of the structure, as shown in FIGS. 2*a* and 3. For example, a table comprised of plank ½" by 1½" surface members may easily be folded to within one and one half or two inches of the surface of a mast, measuring to the outer limits of the surface members (see reference dimension 105 in FIG. 3). By using appropriate means for rotatably attaching the surface members to each other, such as by using simple hinges, the surface assembly may be folded both concavely with respect to the structure (as shown in FIG. 3) and convexly. (The terms convex and concave are taken with respect to the surface of the table proximate the structure. In FIG. 2*a* the relevant surface is the table top; if the table were to depend from its other end, so that it were swung upward to be deployed, the bottom surface would be relevant here and orientations would be reversed.) The degree to which the table may be conformably folded around the structure depends upon the number and size of the surface members relative to the structure about which the table is to be folded, the nature of the rotational attachments or hinges used to connect the members, and the shape ofthe structure to which the table surface is to be conformed. For example, in an embodiment of the table intended for installation next to a mast of 5–10 inches' diameter, a surface assembly might comprise between 5 and 25 (or more) surface members, all hinged as described. The essential point is that the members are relatively small or narrow in comparison to the size of hinged or joined portions in conventional folding tables, which typically comprise ½ to ⅓ of total table surface provided (see, for example, the references cited above). That is not to say, however, that the scope of the invention is restricted to tables having 5–25 surface members. The invention may be practiced quite successfully with as few as three surface members, and in some circumstances with only two; and the upper limits on the number of such members employed in a table is indefinite.

For rotational attachment of the surface members to each other a wide variety of means or devices will serve. What is essential is that the surface members are free to rotate independently with respect to each other, so that the surface assembly may fold or wrap conformally about structures of arbitrary shape. Many common types of hinges, for example, will serve quite satisfactorily, as will "piano" type hinges (hinges of extended length), as shown most clearly in FIGS. 2*a* and 2*b*. As will occur to those familiar with the installation of hinges, the rotational freedom of surface members attached by the use of hinges can be affected by whether the hinge flanges are installed on edges 103 of adjacent surface members or whether they are attached to adjoining top or bottom faces of such members.

Figure 5:
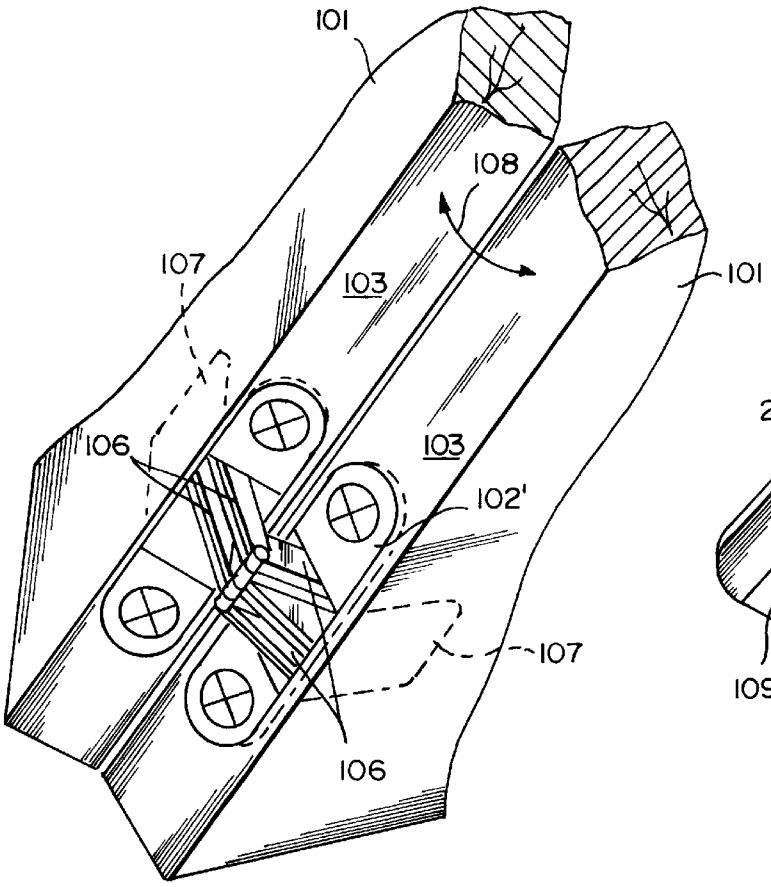
FIG. 5 is a perspective view of a preferred embodiment of an attachment between two surface members of a surface assembly according to the invention.

Many preferred embodiments of the invention use "pocket" hinges, or hinges comprising sets of pinned moment arms, the bodies of which are housed and typically recessed within the hinged structure. An example of a pocket-hinged embodiment of the invention is shown in FIG. 5. The bodies of the two halves of pocket hinge 102' are recessed in edges 103 of adjacent surface members 101, so that the faces of the hinge halves are more or less flush with edges 103 and housings 107 are hidden from view. Pinned moment arms 106 provide physical connection between the surface members. The use of such hinges provides a very sturdy attachment and allows very sure relative rotation of the surface members in the direction of arrows 108. In the opposite sense rotation of the surface members is restricted by contact between the surfaces of edges 103. This circumstance may be used to good advantage in providing for a very flat, planar table surface. As will occur immediately to those familiar with furniture production, when pocket hinges are properly installed in square, well-fitting surface members in a surface assemblies according to the invention, closure of the hinges will result in a very flat continuity between members, as shown in FIGS. 4*a* and 4*b* and in FIG. 3, and a very flat, planar table top surface; and no attempt to further rotate the members (in the sense opposite that of arrows 108) will affect the planar configuration of the surface assembly. Thus when pocket hinges are employed in tables of the general configuration shown in FIGS. 2*a* and 2*b*, the effect of gravitational forces and loads induced by objects placed upon the table surface is to hold the surface assembly in a completely flat, planar tabletop disposition, or to push it into such a position if the table is not fully deployed. This is contrary to the effect of such loads on prior art tables, as previously discussed, in pushing the table out of the horizontal. A further benefit of the use of such hinges is that when the hinges are opened, as shown in FIG. 5, a slight spacing or small opening appears between adjacent surface members. This can greatly facilitate cleaning of the table, as from food scraps or crumbs, by merely "rolling" the surface assembly out of the deployed position of FIG. 2*b* (as shown in FIG. 5) and wiping or cleaning between surface members as necessary. A preferred hinge for use with the invention is the Model #203 SOSS "invisible" hinge available from the Universal Industrial Products Company, One Coreway Drive, Pioneer, Ohio, U.S.A. A preferred mode of installation of such hinges in many tables employing elongated or plank surface members is to "stagger" installation of the hinges by changing or alternating the position of the hinges from the ends of the surface members. This staggering helps to preserve the strength of the surface assembly where dimensions of the surface members are such that recession of the hinges results in the removal of relatively large portions of the surface members, so that strict alignment of the hinges would result in relatively small amounts of wood or surface member material being left between hinge housings.

Figure 6:
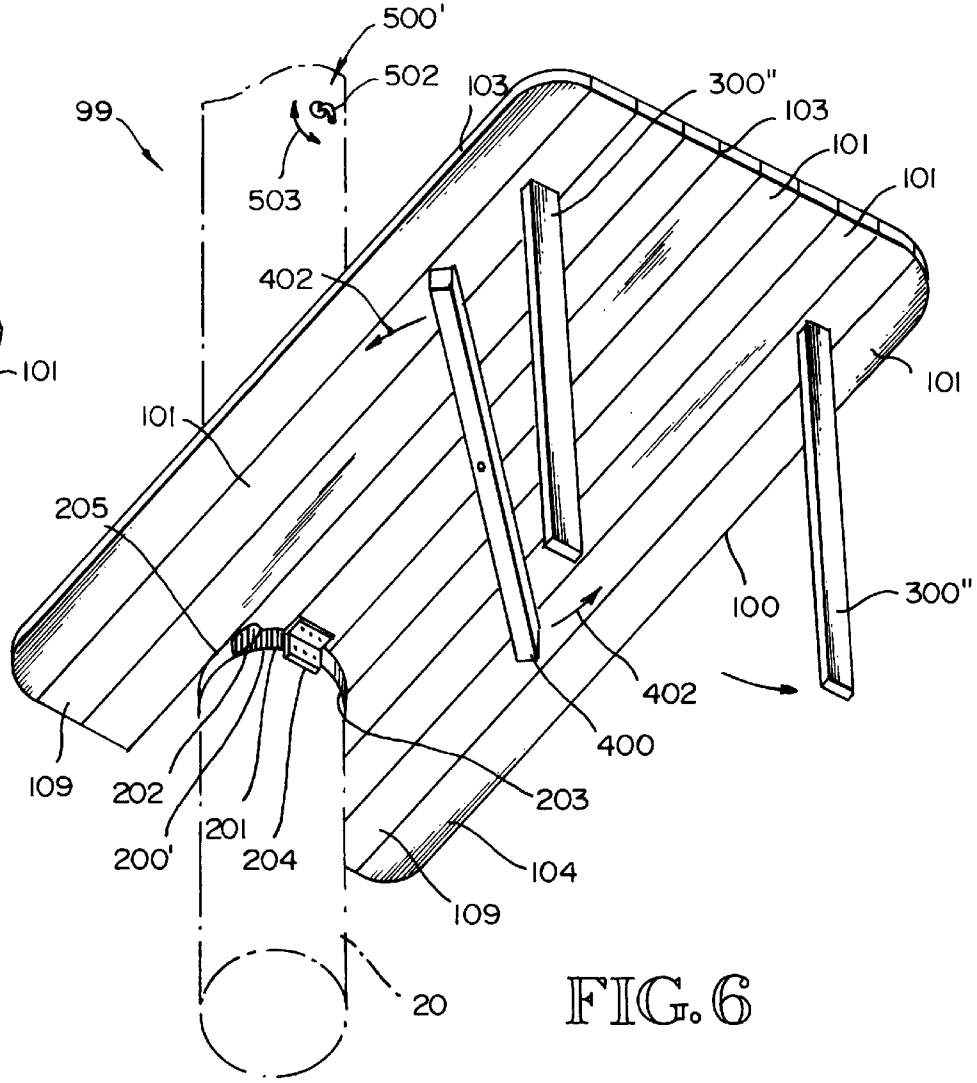
FIG. 6 is a perspective view of a deployed alternative preferred embodiment of a conformally folding table according to the invention.

It is further noteworthy that many aesthetic and functional possibilities are available through shaping of the surface assembly. Rectangular arrangements such as that shown in FIGS. 2*a* and 2*b* are quite satisfactory for many applications; however, both aesthetic and functional advantage may often be realized by rounding the corners of the surface assembly, as shown in FIG. 6, and by tailoring the end of the surface assembly, in the region of the structure to which is attached, to fit around the structure. For example, extensions 109 of the surface assembly as shown in FIG. 6 provide extra table space and can be aesthetically quite pleasing.

In general, preferred embodiments of the invention are permanently or semipermanently attached to the structures with which they are associated, or about which they are intended to fold conformally, like the tables depicted in FIGS. 2*a*, 2*b*, and 6. It is considered, however, that tables merely placed conventionally, as for example on folding legs, in any location fall within the scope of the invention so long as they may be stowed or disposed adjacent to a structure and folded conformally about the structure as herein described.

For embodiments of the invention which are permanently or semipermanently attached to structures, a variety of structural support members (or assemblies), some more or less well known, are available. A simple example is hinge 200 depicted in FIGS. 2*a* and 2*b*, which is conventionally attached to both the structure and to one or more surface members of the surface assembly (preferably one or more central surface members located at or near the middle of the surface assembly). In many instances, however, as for example in many nautical applications, it is not desirable to make permanent attachments to the structure, particularly where the structure might be damaged or permanently altered in the process. For example, it is often considered detrimental to make holes, as for screws or bolts, in masts of sailing vessels. Thus in many applications in which it is envisioned that the invention will be employed semi-permanent or removable attachments are desired. One example of a removable or semi-permanent structural attachment is the strap clamp shown in FIG. 6. Attachment 200' comprises scored band or 201 and tightening bolt 202 in housing 205, with hinge 203 attached to the strap. Attachment 200' is identical in operation to common hose clamps; tightening bolt 202 is disposed within a housing adjacent to the scored band such that rotation of the bolt in one direction causes a thread on the bolt to engage scoring on the band, thus tightening the band, while rotation of the bolt in the opposite sense results in loosening of the band. Such a band-type attachment may be attached securely and semipermanently to a post, column, mast, or other cylindrical or semi-cylindrical structure with relative ease and reliability, and may provide an extremely strong attachment and mounting for the table. In such embodiments hinge 203 is attached to the surface assembly of the table in the manner shown in the Figure and as herein elsewhere described. Block 204 serves to provide clearance for the surface assembly as the table is pivoted into a stowed or deployed position.

Figure 7B:
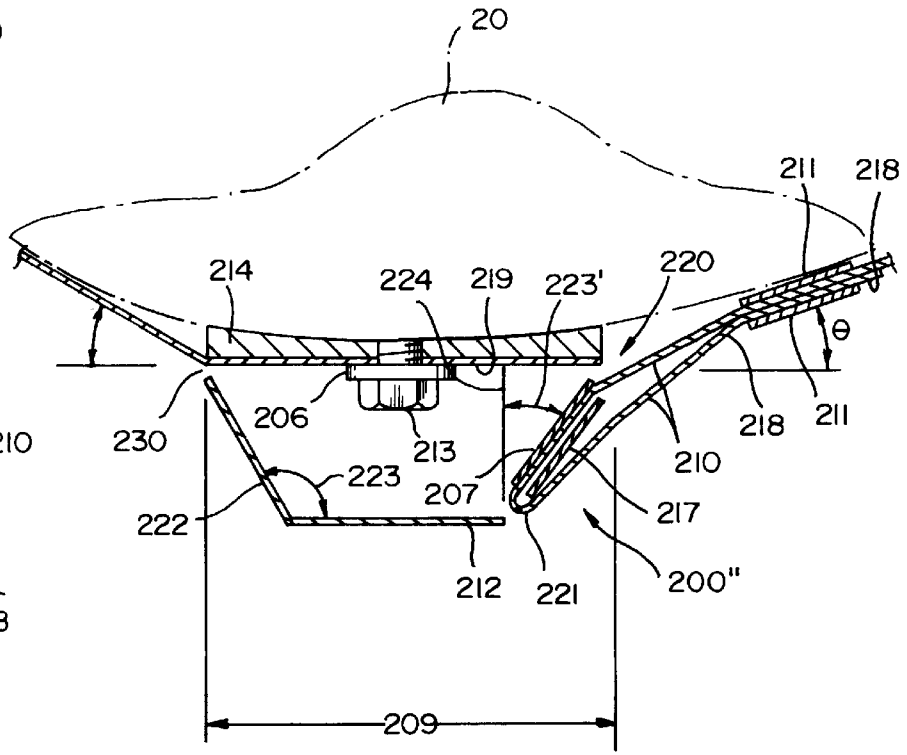
FIG. 7*b* is a partial cross-section of a preferred embodiment of a strap clamp structural support member according to the invention, taken along line 7*b*—7*b* in FIG. 7*a*.
Figure 7A:
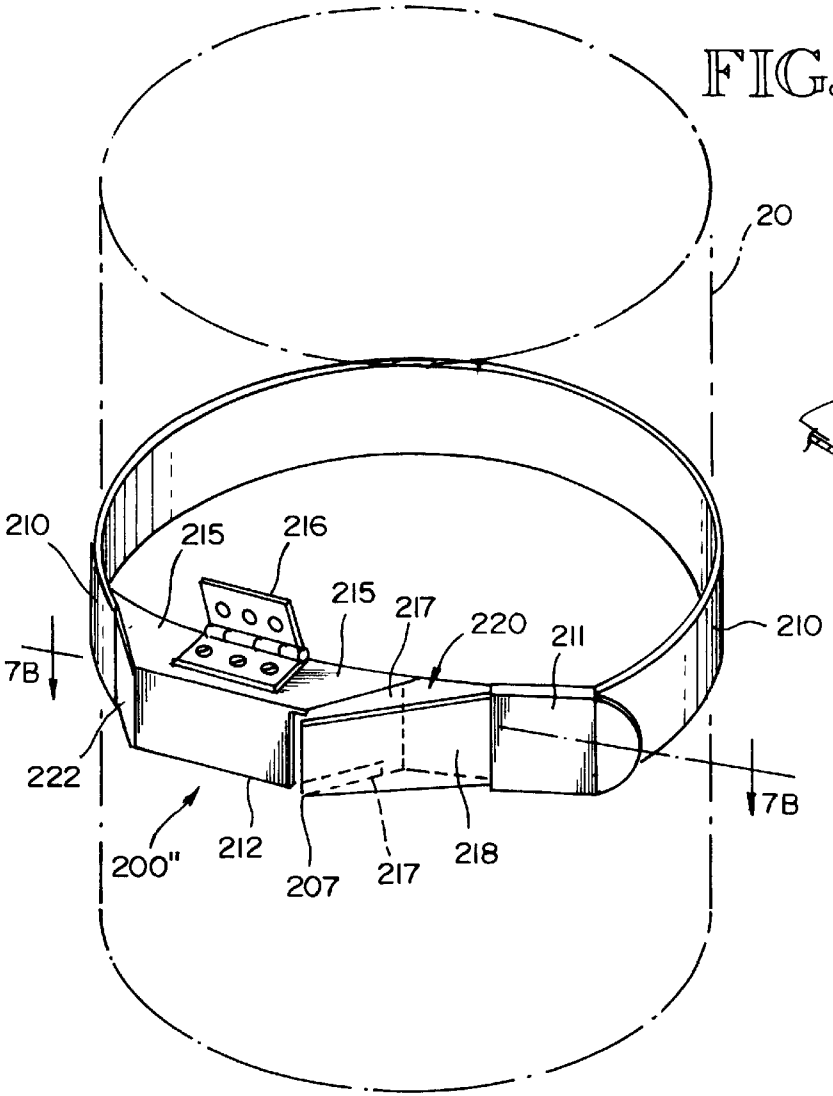
FIG. 7*a* is a perspective view of a preferred embodiment of a strap clamp structural support member according to the invention.

Another example of a removable or semi-permanent structural attachment is the strap clamp shown in FIGS. 7*a* and 7*b*. Attachment 200" comprises strap or band 210, binder 211 (shown in the form of a clip), flange 212, bolt 213, and plate 214. A preferred embodiment of the attachment is fabricated by forming the strap and flange from a single piece of sheet stock (as for example 0.08 inch aluminum sheet, or any structural material, such as plastic, etc.), bending or otherwise forming the flange to make a base 215 for attaching hinge 216 or other means for pivotally attaching a surface assembly, retaining tab (or "retainer") 217, which is shown with optional lip or channel 207 and which serves to help keep bight 221 and second end 218 of the strap in place relative to the clamp assembly, and tab 222. The attachment is then placed in position relative to structure 20 and strap 210 is bent around the structure so as to gird and/or circumferentially engage the structure, and so that second end or end portion 218 of the strap extends through gap 220 left between end 219 of the strap and the retainer and bends around retainer 217 as shown, so that retainer 217 is trapped in bight 221 thus formed and end portion 218 may be bound with strap 210 by clip 211. With plate 214 disposed between strap 210 and the structure, bolt 213 is threaded against structure 20 and tightened until strap 210 is drawn tight enough to fix attachment 200" sufficiently to support the table assembly attached to hinge 216. Tightening of bolt 213 may, if plate 214 is sufficiently stiff and strong, open a gap 208 (shown in FIG. 7*c*) between the strap and the structure. Optional nut 206 is attached, as by spot welding, to the outer surface of first end so as to enhance engagement of the strap an the nut. Strap clamp 200" is optionally loosened, as for removal of the clamp from structure 20, by backing off the bolt, removing clip 211, and removing the strap.

Figure 7C:
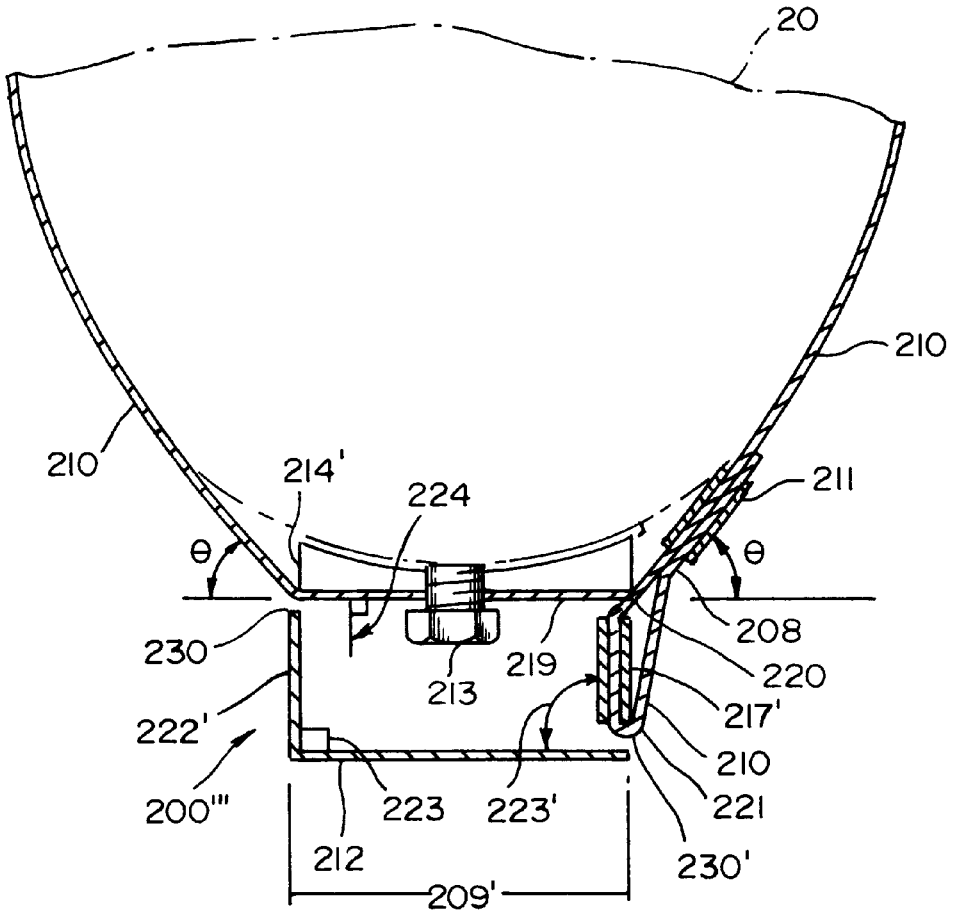
FIG. 7*c* is a partial cross-section of an alternative preferred embodiment of a strap clamp structural support member according to the invention, as if taken along line 7*b*—7*b* in FIG. 7*a*.

An alternative embodiment of the strap clamp of FIGS. 7*a* and 7*b*, adapted for use with relatively smaller structures than the clamp of FIGS. 7*a* and 7*b*, is shown in FIG. 7*c*. That is, structure 20 of FIG. 7*c* has a smaller average or effective (in the case of non smoothly-curved structures) radius, when compared to length 209' of base 215 (not shown in FIG. 7*c*, but c.f. FIG. 7*a*), than length 209 in FIG. 7*b*. Thus the clamp of FIG. 7*c* comprises a relatively larger base for the attachment of the surface assembly of the table, or other object, and a relatively longer substantially flat portion of strap end 219, than that shown in FIGS. 7*a* and 7*b*, with the result that the angles θ and θ' between the strap and substantially flat end portion 219 in FIG. 7*c* are larger than they are for those of the other Figures. In order to provide a stiffer and more efficient load path within the clamp, and therefore a surer engagement of the structure by the clamp, retainer 217 of the clamp shown in FIGS. 7*a* and 7*b* is angled with respect to normal 224 extended from strap first end 219 (which, being disposed adjacent to block 214, is typically substantially flat) of the strap, as shown by angle 223'. Thus the load path along the strap is kept as straight, and therefore as structurally efficient, as possible. In FIG. 7*c*, angle θ' is large enough that construction of retainer 217' substantially normal to first end 219 of the strap provides a sufficiently stiff load path.

It may be seen that the stiffness, and therefore the gripping strength of strap clamps according to the invention, may be varied according the type and gauge of materials used, and the actual geometry selected for fabrication of the strap. For example, placement of binder clip 211 closer to bight 221 in the Figures can provide a stiffer and stronger tie-down for end 218 of the strap, and controlling the dimensions of gaps 220 and 230 between various flanges and tabs of the assembly can be used to provide more stiffness in the support for end 218 of the strap; control of angle 223' can also be used to control stiffness the clamp.

Preferred strap clamps according to the invention are comprised of metal, typically chiefly structural aluminum. Any material of sufficient strength, damage tolerance, formability, and fatigue and corrosion resistance will serve, however. For example, in many applications plastics or other polymers, such as polyvinyl chloride or nylon, will serve. It has been found that strap clamps may be made very economically and efficiently of single-piece sheet metals bent to form bases 215 and the various flanges and retaining tabs. It has been found that Delron serves very well for making blocks 214.

Preferred embodiments of the table of the invention comprise one or more stability members adapted to engage and provide support to the surface assembly when the table is in the deployed position. It is possible, of course, and in many circumstances desireable, to provide tables according to the invention without dedicated stability members, but superior strength-to-weight ratios may be realized in such tables by the addition of stability members as herein described. Stability members may be provided in any number of conventional means, such as foldable brackets or braces, as will be appreciated by those of ordinary skill in the art of furniture production and collapsible furniture design. It has been found, however, that among the most efficient stability members are legs attached by hinges to one or more surface members, as shown in FIGS. 2*a* and 2*b*, 4*a* and 4*b*, and 6. In FIGS. 2*a* and 2*b* stability member 300, shown as a foldable table leg, is attached by means of a hinge to a central surface assembly member 101. When the table is in the stowed position, as in FIG. 2*a*, the leg hangs by its hinge against the surface member 101; when the table is deployed the leg extends downward to contact the floor and support the otherwise free end of the table, as shown. In the table shown in FIG. 6 two such legs 300" are provided. In FIGS. 4*a* and 4*b* leg 300' is attached by hinge 111 to relatively broad central surface element 110, which has been made broader than remaining surface members 101 in order to accommodate both leg 300' and lateral support element 400'. It is also anticipated that in many embodiments stability members according to the invention may be removable, for separate stowage and installation.

Preferred embodiments of the invention further comprise (optional) lateral support elements which are selectively engageable with a plurality of the surface members of the surface assembly and adapted to support the surface members when the surface assembly is "unwrapped" in a tabletop alignment. Examples of lateral support elements are shown in FIGS. 2*b*, 4*a* and 4*b*, and 6. In FIG. 2*b* lateral support element 400 is provided as a separate piece adapted to slide into brackets 401 and thereby support each of the support elements of surface assembly 101 in a substantially planar disposition. Even in preferred embodiments in which hinges or rotational attachments 102 are adapted to rigidly support the surface members 101 to which they are attached from rotating past a planar disposition, as previously described, lateral support element 400 will, in addition to helping keep the table top flat, aid surface elements 101 in supporting the weight of the surface assembly and any objects or loads placed on or induced in the table top (note that in such embodiments the lateral support element need not extend all the way to support edge surface members 104). Preferred embodiments of the lateral support of the invention are pivotally mounted to members of the surface assembly as shown in FIGS. 4*a* and 4*b* (in which lateral support element 400' is pivotally attached to broadened support member 110 and in FIG. 6. In FIGS. 4*a* and 4*b* lateral support member (or element) 400' is adapted to fit conformally against stability member 300' when the support member and leg are in a stowed position, as shown in FIG. 4*a* (the stowed position being shown in broken line). As the table is deployed, leg 300' swings away from the surface assembly and from lateral support element 400' so that the lateral support element may be pivoted in the direction of arrows 402 to engage and support the surface assembly members 101 (shown in FIG. 6 also). Conformal fitting of the stability member and lateral support member is both aesthetically pleasing and functional, in that the lateral support element may be restrained from unwanted rotations when stowed. The functional aspects of the configuration, however, may be accomplished in a great number of other ways.

Preferred embodiments of the invention are further optionally provided with stowage restraint elements to support the tables in the stowed position, as shown in FIGS. 2*a* and 6. Such restraint elements are optional because, as will appear to those having elementary familiarity with mechanics, tables mounted as shown in the Figures will tend to stay in the stowed position under the influence of their own weight, due to the position of their own centers of gravity with respect to their structural support elements. In many applications, however, especially those like marine craft exposed to significant motion, restraint elements will provide additional safety by further securing the table in the stowed position. Straps provided with hook and loop fasteners and adapted to encircle the surface assembly (or one or more surface assembly members) and the structure, as shown in FIG. 2*a*, will serve satisfactorily, especially when provided (as shown in FIGS. 4*a* and 4*b*) with additional hook or loop material attached to external surfaces of the stowed table (see Reference 501 in FIGS. 4*a* and 4*b*). Other conventional devices will serve also, as for example hook device 502 shown in FIG. 6. In such configurations hook 502 is adapted to swivel in the direction of arrows 503, to selectively engage or disengage the extremities of surface assembly 100 and thus hold it in place.

The preferred embodiments of the invention shown in the Figures depict the table as being attached to the supporting structure at the lower end of the stowed table (see FIGS. 2*a* and 6), so that when the table is stowed it is meant to be pivoted upward. It is considered that tables according to the invention may also be attached to the supporting structure and allowed to hang downward for stowage. It has been noted, however, that to a large extent the permissible size of the surface assembly is to a large extent affected by the height above the floor it is desired to mount the table at. Still, such tables are considered to fall within the scope of the invention.

Preferred tables according to the invention are fabricated from wood, plastic, or metal. Most furniture grade embodiments are to the extent possible made of close-grained woods, such as teak, mahogany, or maple. As will be appreciated by those familiar with the art of furniture production, however, any materials of sufficient strength, durability, damage tolerance, and corrosion resistance will serve.

With regard to systems and components above referred to, but not otherwise specified or described in detail herein, the workings and specifications of such systems and components and the manner in which they may be made or assembled or used, both cooperatively with each other and with the other elements of the invention described herein to effect the purposes herein disclosed, are all believed to be well within the knowledge of those skilled in the art. No concerted attempt to repeat here what is generally known to the artisan has therefore been made.

INDUSTRIAL APPLICABILITY

The invention has applicability to the field of furniture, and in particular to foldable or collapsible tables for use in small spaces and in vehicles. The invention provides improvements in stowage and deployment of such tables.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

What is claimed is:

1. A conformally folding table hingedly attached at one end thereof to an elongate, vertically extending support structure comprising:

a surface assembly, the surface assembly comprising a plurality of surface members having sides, the surface members disposed in a series such that the sides of adjacent surface members are substantially juxtaposed, adjacent surface members being rotatably attached to each other; and a structural support member adapted to pivotally attach one of said plurality of surface members to said elongate, vertically extending support structure;

whereby the table may be positioned in a first stowed position relative to said support structure and the surface assembly conformally folded about said support structure; and the table may be pivoted into a deployed position with the surface assembly unfolded and secured into a tabletop configuration.

2. The table of claim 1, wherein the surface assembly comprises at least three surface members disposed in such series, one of said members being rotatably attached to said support structure.

3. The table of claim 1, wherein the surface members are elongated.

4. The table of claim 1, wherein adjacent surface members are rotatably mounted to adjacent members by pocket hinges.

5. The table of claim 1, wherein the structure comprises a post.

6. The table of claim 1, wherein the structural support member comprises a strap clamp.

7. The table of claim 1, further comprising at least one stability member adapted to engage and provide support to the surface assembly when the table is in the deployed position.

8. The table of claim 1, further comprising at least one lateral support member selectively engageable with a plurality of said surface members and adapted to support the surface members in a tabletop alignment.

9. The table of claim 8, wherein the lateral support member is pivotally attached to one of the surface members.

10. The table of claim 1, further comprising a stowage restraint element adapted to support the table in the stowed position.

11. A conformally folding table comprising:

a surface assembly, the surface assembly comprising at least three elongated surface members having sides, the surface members disposed in a series such that the sides of adjacent surface members are substantially juxtaposed, adjacent surface members being rotatably attached to each other;

at least one stability member adapted to engage and provide support to the surface assembly when the table is in a deployed position;

at least one lateral support member pivotally attached to one of the surface members and selectively engageable with a plurality of the remaining surface members, and adapted to support the surface members in a tabletop alignment; and a structural support member comprising a strap clamp adapted to pivotally attach the surface assembly to a post;

whereby the table may be pivoted into a stowed position relative to said structural support member and the surface assembly conformally folded about said post; and the table may be pivoted into a deployed position and the surface assembly unfolded into a tabletop configuration.

* * * * *